United States Patent [19]

Coone

[11] 4,175,592

[45] Nov. 27, 1979

[54] TUBULAR MEMBER SEAL ENCLOSING AND ENCLOSURE RELEASING APPARATUS

[75] Inventor: Malcolm G. Coone, Houston, Tex.

[73] Assignee: Lynes, Inc., Houston, Tex.

[21] Appl. No.: 943,596

[22] Filed: Sep. 18, 1978

[51] Int. Cl.[2] ..... E02D 5/00; F02B 17/04

[52] U.S. Cl. ..... 138/89; 138/94; 465/227

[58] Field of Search ..... 138/89, 94, 89.1, 89.2, 138/89.3; 405/195, 225, 227; 220/428; 277/27

[56] References Cited

U.S. PATENT DOCUMENTS

| | | | |
|---|---|---|---|
| 3,488,967 | 1/1970 | Toossi | 220/428 |
| 3,533,241 | 10/1970 | Bowerman | 405/227 |
| 3,613,936 | 10/1971 | Kaiser | 138/89 |
| 4,024,723 | 5/1977 | Mayfield | 405/227 |
| 4,087,978 | 5/1978 | Landers | 405/227 |
| 4,118,942 | 10/1978 | Liautaud | 405/227 |
| 4,142,371 | 3/1979 | Mayfield | 138/89 |

*Primary Examiner*—Robert I. Smith

*Attorney, Agent, or Firm*—William C. Norvell, Jr.

[57] ABSTRACT

The invention incorporates a combination tubular member seal enclosing and enclosure releasing apparatus having an elastomeric sealing means with interior and exterior edges. The exterior edge is disposed around one end of the tubular member for sealing across the interior of the tubular member. First and second flange members define a housing for securement of the interior edge of the sealing means and are circumferentially extendible within the tubular member. First and second seal extending means have an end secured to a respective flange member. Piston means which are telescopically operational include a piston housing having a port therein and a piston element slidably disposed with respect to the housing. One of the seal extending means has another end thereof which is engaged with one of the piston housing and the piston element while the other of the seal extending means has another end thereof engaged with the other of the piston housing and the piston element. A piston chamber contains fluid pressure for telescopic operation of the piston means. Plug means are initially sealingly disposed within the port of the piston means and are selectively disengageble therefrom to urge and release at least one of the first and second flange members away from and out of securement with the elastomeric sealing means.

7 Claims, 4 Drawing Figures

TUBULAR MEMBER SEAL ENCLOSING AND ENCLOSURE RELEASING APPARATUS

BACKGROUND OF THE INVENTION

1. Field of the Invention

The invention relates to an apparatus for readily sealingly engaging and selectively disengaging one end of a tubular member, such as a cylindrical leg extending downwardly onto the sea bed from the platform utilized in the drilling and completion of subterranean oil and gas wells.

2. Description of the Prior Art

Seal means defining a diaphragm element oftentimes are disposed upon the lowermost end of a platform leg for enabling flotation of the platform to an offshore location. When the platform approaches the desired location for leveling of the platform on the sea bed, the seal means are punctured, thus enabling a flood of water to enter into the leg whereby the legs thereafter rest upon the ocean floor. Additionally, such sealing means oftentimes are placed upon the lowermost end of a tubular member, such as a platform leg, to prevent contaminant, such as silt and gravel and other debris, from entering the tubular member prior to the insertion therethrough of a piling element for anchoring the sleeve with the sea bed. After the piling is inserted within the interior of the sleeve, the lower end of the piling contacts and engages the sealing means, whereby the sealing means is ruptured, permitting the piling to pass therethrough, with the inner edges of the sealing means acting as a wiper to remove particulate matter from the exterior of the piling and to prevent foreign matter, as well as liquid, from passing from below to above the diaphragm and within the annulus area thereabove between the piling and the sleeve, to enable a more effective grouting of the annulus to secure the piling to the sleeve. Such sealing means are well known to the art, and are typified by that disclosed in U.S. Pat. No. 3,533,241, to B. H. Bowerman, et al, entitled "Rupturable Seal Assembly For Piling Guides".

When utilizing such seal assemblies, it is highly desirable to provide controlled flooding of the interior of the sleeve by selective sealing disengagement of the seal means from the sleeve. Additionally, when a sleeve carrying a seal means is exposed to a high pressure environment, such as that found when a platform is to be landed at a comparatively deep water depth, oftentimes the seal means so utilized will be elastomerically reinforced, but will still be exposed to high pressures. Therefore, it is desirable to reduce the overall exposure of the seal means to such high pressure by providing a fluid tight element across the lower end of the tubular member, or sleeve, which is resistant to the effects of such high pressure.

The present invention provides considerable improvement over apparatuses utilized in the past by providing means somewhat less resistant to the effects of high pressure whereby the seal means may be selectively disengaged from the tubular member, or sleeve, to permit controlled flooding of the interior of the sleeve. The apparatus is of relatively simple construction and is comparatively inexpensive to manufacture and assemble.

SUMMARY OF THE INVENTION

The present invention defines a combination tubular member seal enclosing and enclosure releasing apparatus which has an elastomeric sealing means having interior and exterior edges, the interior edge being disposed immediate an end of the tubular member and engaged around the tubular member for sealing across the interior of the tubular member. First and second flange members initially define a housing for securement of the interior edge of the sealing means with the flange members being circumferentially extendible within the tubular member. First and second seal extending means have an end thereof which is secured to a respective flange member. Telescopically operational piston means having a piston housing with a port therein and a piston element slidingly disposed with respect to the housing is provided with one of the seal extending means having another end thereof which is engaged with one of the piston housing and the piston element, while the other of the seal extending means having another end thereof is engaged with the other of said piston housing and said piston element. Piston chamber means are provided between the piston housing and the piston element for initital fluid pressure expansion between the piston housing and the piston element. Plug means are provided and are initially sealingly disposed within and selectively disengageable from the port. Means for selectively disengaging the plug from the port for telescopically expanding the piston means urge and release at least one of the first and second flange members away from and out of securement with the elastomeric sealing means.

DESCRIPTION OF THE PREFERRED EMBODIMENTS

Figure 1:
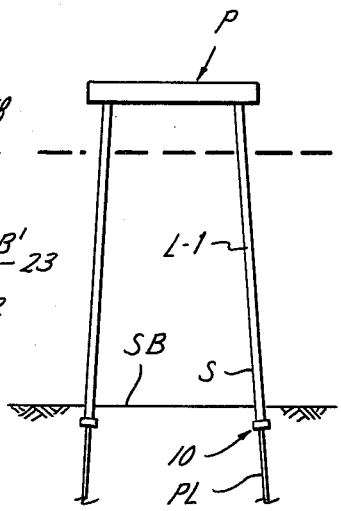
FIG. 1 is a schematic illustration of a platform being lowered to the ocean floor with a tubular sleeve member thereof having affixed immediate its lower end the apparatus of the present invention.

Referring now to FIG. 1, a platform P is disposed upon the upper end of a plurality of legs L-1, each leg L-1 being disposed upon the sea bed SB of an ocean.

Figure 2:
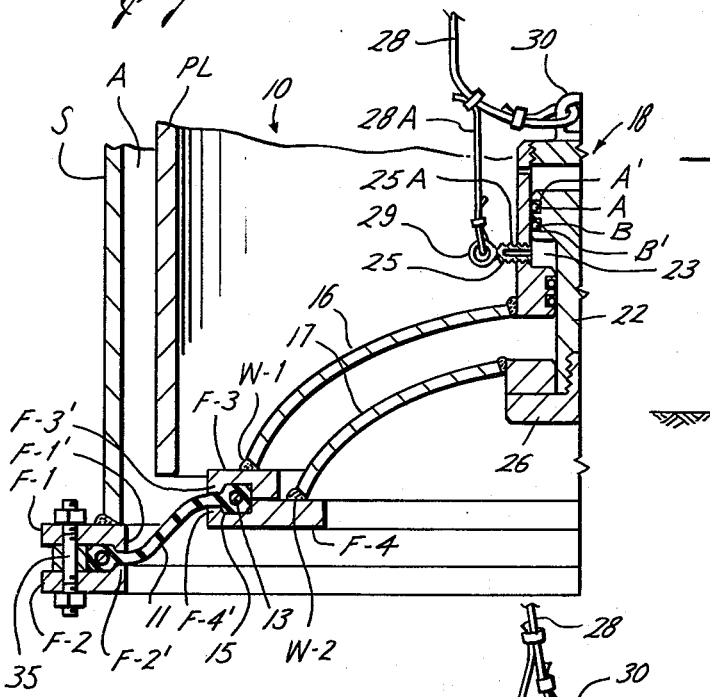
FIG. 2 is a cross-sectional illustration of the apparatus of the present invention in sealingly engaged position across the interior of the tubular sleeve member prior to telescopic contraction of the piston means, with a piling element being disposed within the sleeve and above and around the apparatus of the invention.

Now referring to FIG. 2, each leg L-1 is composed of a plurality of longitudinally extending tubular members or sleeves S with upper and lower circumferentially extending flanges F-1 and F-2, respectively, therebelow, the upper flange element F-1 having an inwardly and lowerly protruding lip element F-1′ and the lower flange element F-3 having a companion inwardly protruding upper lip element F-2′ for receipt therethrough of one end 12 of the seal means 11. When the upper and lower flanges F-1 and F-2 are secured by bolt 35 or other means, the lips F-1′ and F-2′ snuggly secure the end 12 of the seal means 11 within and between the secured flanges F-1 and F-2. The seal means 11 is of known construction, is generally elastomeric in nature, and may be steel or fabric reinforced. The seal means 11 has its interior seal end 13 disposed within a bore 15 defined within and between upper and lower flanges F-3 and F-4, respectively, with lips F-3′ and F-4′ of similar construction as lips F-1′ and F-2′ for securement of the end 13 of the seal means 11 within the bore 15 and between the flanges F-3 and F-4.

Figure 3:
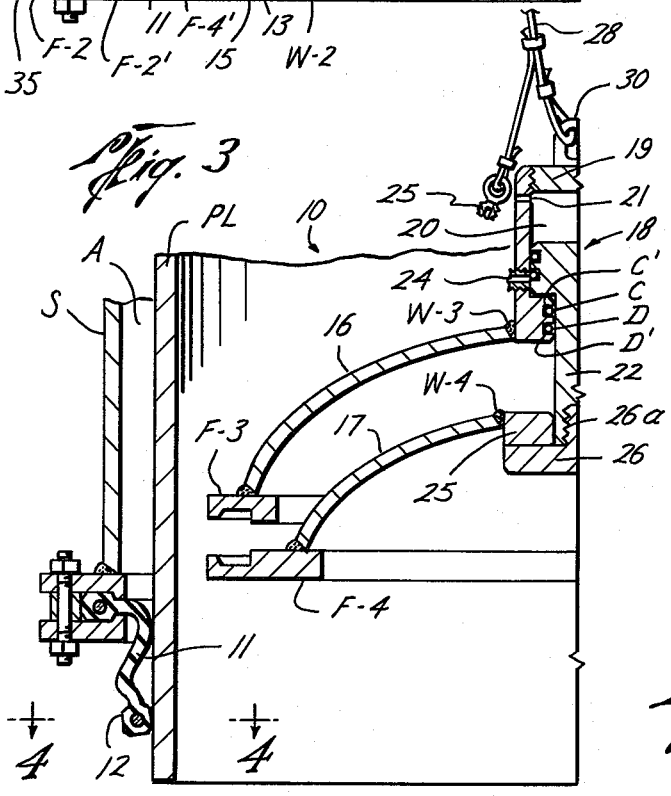
FIG. 3 is a cross-sectional view similar to that shown in FIG. 2 illustrating the elastomeric sealing means released completely away from the other components of the apparatus of the present invention, with the piling being completely disposed longitudinally thereacross.
Figure 4:
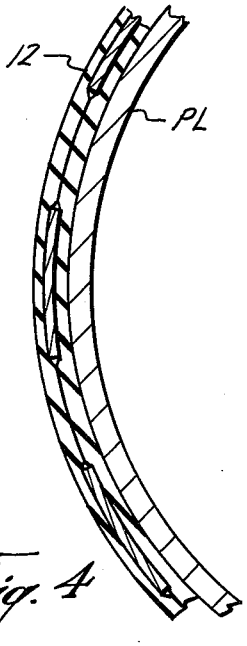
FIG. 4 is a cross-sectional view taken along Lines 4—4 of FIG. 3.

The flanges F-3 and F-4 are respectively secured to the upper and lower seal extending means 16 and 17 by means of welds W1 and W2. As illustrated in FIGS. 2 and 3, the seal extending means are plate-like and are of dome configuration, being generally semi-circular in nature. The upper seal extending means 16 is secured by means of weld W3 to the exterior of the housing 19 of the piston means 18, while the lower seal extending means 17 is affixed by means of weld W4 to a shoulder 27 resting above a cap 26 which is secured by means of threads 26A to a piston element 22 of the piston means 18.

The piston means 18 is disposed through the center of each of the upper and lower seal extending means 16 and 17. The upper end of piston means 18, as well as the uppermost exterior portion thereof, is defined by means of a cylindrical housing 19 having a ring 30 at its uppermost end for securement therethrough of the disengaging means 28. A cylindrical chamber 20 is defined interior of the piston means 18 for communication, continuously, with a port 21 exposed to a pressure exterior of the piston means 18.

Interior of the piston means 18 and telescopically disposed therein is a longitudinally extending piston 22 with elastomeric seal means A and B circumferentially defined therearound within their respective grooveways A′ and B′ to prevent fluid communication between the piston element 22 and the housing 19 as the piston element 22 is telescopically shifted within the housing 19. Similarly, companion elastomeric seal elements C and D are circumferentially disposed within their respective grooveways C′ and D′ defined interiorly of and around the lowermost portion of the housing 19, also to prevent fluid communication between the housing 19 and the piston element 22. Additionally, the seal means B and C define the upper and lowermost ends, respectively, of a chamber 23 defined between the piston element 22 and the housing 19 of the piston means 18 for containment of fluid, initially, under pressure, to telescopically expand the piston element 22 and the housing 19 in order to adapt the upper and lower seal extending means 16 and 17 together with their respective flanges F-3 and F-4 for proper securement of the seal means 11 within the bore 15. A plug element 25 is disposed through the housing 19 and secured therein by means of threads 25A to contain the fluid under pressure within the chamber 23. However, the plug 25 is shearably releasable from within its port 24 in the housing 19, with a ring 29 being disposed at the exterior end of the plug 25 for engagement therein of a lanyard extension 28A of the disengaging means, such as a wire line 28, which is secured thereto.

OPERATION

When it is desired to release the apparatus 10 from sealing engagement across the sleeve S, for lowering of the platform apparatus to the sea bed SB, or when the grouting procedure is to be initiated for grouting of the annulus A between the sleeve S and the piling PL, upward tensive force is applied to the disengaging means 28 whereby the lanyard 28A is stiffened to shear the plug 25 out of the port 24, thus exposing the chamber 23 to the pressure exterior of the piston means 18. Since the pressure within chamber 23 is somewhat higher than that of the exterior of the piston means 18, fluid will pass out of the chamber 23, through the port 24, and exterior of the piston means 18, thus enabling the piston element 22 and the housing 19 to telescopically expand with respect to one another, whereby the upper seal extending means 16 and the lower seal extending means 17 are flexed, enabling the flanges F-3 and F-4 to become sealingly disengaged from the interior seal end 13 of the seal means 11. This position is as shown in FIG. 3.

Thereafter, the disengaging means 28 is manipulated out of the sleeve S, longitudinally, to remove the interior portions of the apparatus 10, save the seal means 11, which is retained within the interior sleeve S, and is still engaged between the upper and lower flanges F-1 and F-2. Meanwhile, the piling PL being inserted interior of the sleeve S to define an annulus A therebetween, the piling PL is longitudinally shifted lowerly of the flanges F-1 and F-2 whereby the lower open end of the piling PL passes below the seal means 11 which is now, preferably, segmented to enable the interior surface of the seal means 11 to expand for allowing the piling PL to pass through and then contract to wipe against the exterior surface of the piling PL, to act as a wiper to remove particulate matter from the exterior of the piling PL and to prevent fluid and particulate matter from entering the annulus A above the seal means 11 and between the sleeve S and the piling PL. Thereafter, the annulus A may be grouted for sealing the annulus A and securing the piling PL to the sleeve S.

Although the invention has been described in terms of specified embodiments which are set forth in detail, it should be understood that this is by illustration only and that the invention is not necessarily limited thereto, since alternative embodiments and operating techniques will become apparent to those skilled in the art in view of the disclosure. Accordingly, modifications are contemplated which can be made without departing from the spirit of the described invention.

What is claimed and desired to be secured by Letters Patent is:

1. A combination tubular member seal enclosing and enclosure releasing apparatus, comprising: elastomeric sealing means having interior and exterior edges, the interior edge thereof being disposed immediate one end of said tubular member and engaged therearound for sealing across the interior of said tubular member; first and second flange members initially defining a housing for securement of the interior edge of said sealing means, said flange members being cicumferentially extendible within said tubular member; first and second seal extending means having an end thereof secured to a respective flange member; telescoping piston means comprising a piston housing having a port therein and a piston element slidably disposed with respect to said housing, one of said seal extending means having another end thereof engaged with one of said piston housing and said piston element and the other of said seal extending means having another end thereof engaged with the other of said piston housing and said piston element; piston chamber means between said piston housing and said piston element for initial fluid pressure expansion between said piston housing and said piston element; plug means initially sealingly disposed within and selectively disengageable from said port; and means for selectively disengaging said plug from said port for telescopically expanding said piston means to urge and release at least one of said first and second flange members away from and out of securement with said elastomeric sealing means.

2. The apparatus of claim 1 wherein said elastomeric sealing means comprises a reinforced flexible diaphragm element.

3. The apparatus of claim 1 wherein said elastomeric sealing means is at least partially segmented circumferentially and comprises a reinforced flexible diaphragm element, each of said elements housing segmented means for additional securement of said elastomeric sealing means within said first and second flange members.

4. The apparatus of claim 1 wherein one of said first and second flange members is completely disposed around the interior edge of said sealing means and the other of said first and second flange members is segmentally disposed around the interior edge of said sealing means.

5. The apparatus of claim 1 wherein said seal extending means are a semi-circular dome and said telescoping piston means is disposed through each of the approximate centers thereof.

6. In a combination tubular member sealing enclosing and enclosure releasing apparatus comprising an elastomeric sealing means having interior and exterior edges, the exterior edge thereof being disposed immediate one end of said tubular member and engaged therearound for sealing across the interior of said tubular member, the improvement comprising: telescoping piston means comprising a piston housing having a port therein and a piston element slidably disposed with respect to said housing whereby upon telescopic expansion of said piston means said elastomeric sealing means becomes sealingly disengaged from across said tubular member.

7. In a combination tubular member sealing enclosing and enclosure releasing apparatus comprising an elastomeric sealing means having interior and exterior edges, the exterior edge thereof being disposed immediate one end of said tubular member and engaged therearound for sealing across the interior of said tubular member, the improvement comprising: telescoping piston means comprising a piston housing having a port therein and a piston element slidably disposed with respect to said housing whereby upon telescopic shifting of said piston means said elastomeric sealing means becomes sealingly disengaged from across said tubular member.

* * * * *